US005605135A

United States Patent [19]

Netherwood

[11] Patent Number: 5,605,135

[45] Date of Patent: Feb. 25, 1997

[54] ENGINE MANAGEMENT SYSTEM

[76] Inventor: John Netherwood, 3146 N. Coronado St., Chandler, Ariz. 85224

[21] Appl. No.: 508,299

[22] Filed: Jul. 27, 1995

[51] Int. Cl.[6] ..... F02D 41/22

[52] U.S. Cl. ..... 123/479; 364/431.11

[58] Field of Search ..... 123/479, 417, 123/480; 364/431.11

[56] References Cited

U.S. PATENT DOCUMENTS

| | | | |
|---|---|---|---|
| 3,834,361 | 9/1974 | Keely | 123/479 |
| 4,989,569 | 2/1991 | Eidler | 123/479 |
| 5,497,751 | 3/1996 | Ohtake | 123/479 |

*Primary Examiner*—Tony M. Argenbright
*Attorney, Agent, or Firm*—Gregory J. Nelson

[57] ABSTRACT

An engine management system for regulating fuel delivery to an engine. The system has a primary engine control unit (ECU) and a secondary ECU interconnected by a switching system. A microprocessor in the primary ECU receives signals from primary sensors to regulate the injectors to deliver the proper A/F ratio. In the event of primary sensor failure or computer problem, the microprocessor relies on a selected alternate sensor input. Secondary sensors "fine tune" the control signal from the primary ECU. Switching to the secondary ECU is automatically accomplished by a switching unit upon the existence or loss of an output signal from the primary ECU. In the preferred embodiment, the switching unit includes three normally closed relays, the first two of which are for independent power supply. Upon loss of a signal from the primary, the first two relays close directing power to the secondary ECU and illuminating a trouble light. The secondary ECU operates by monitoring one or more basic control parameters.

12 Claims, 3 Drawing Sheets

ENGINE MANAGEMENT SYSTEM

BACKGROUND OF THE INVENTION

1. Field of the Invention

The present invention relates to an engine management system and more particularly relates to a system for controlling delivery of fuel to an internal combustion engine such as an aircraft engine which system has a primary control unit and a secondary control unit. Switching from the primary control unit to the secondary control unit occurs under certain predetermined operational conditions.

2. Background of the Invention

Redundant engine management systems for internal combustion engines are well known. For example, aircraft engines conventionally have back-up electrical and fuel systems in the event of a failure. The following patents are representative of prior art systems in this area.

U.S. Pat. No. 4,577,605 discloses an arrangement for controlling fuel metering to an internal combustion engine which is equipped with a microprocessor and an emergency control system. In the event of a microprocessor failure due to a defect, the system attempts to restart the microprocessor. At the same time, an emergency operation pulse generator assumes control of the fuel metering apparatus. The emergency control system is stated to be particularly suited for fuel metering apparatus which serve to control internal combustion (IC) engines for motor vehicles.

U.S. Pat. No. 5,233,964 shows an auxiliary control for reducing the processing load of an engine computer by directly controlling a fuel injection system of an IC engine. When the computer is unable to provide updated delay times and pulse with time periods, the auxiliary controller maintains limited engine operation in the event of a failure of the engine control computer. A delay time and a pulse width time period are continuously calculated by the engine controller and are provided to the auxiliary controller. The most recently-received delay time and pulse width time period are then used by the auxiliary controller to control up to eight identified fuel injectors. By initializing the auxiliary controller each time it is used, the auxiliary controller can be made universal in that one controller design can be used to interchangeably service a variety of engines.

U.S. Pat. No. 4,750,463 discloses an electronically regulated fuel injection system for an internal combustion engine with a switchable safety and emergency driving device which mechanically couples the accelerator pedal to the regulator. The coupling operatively interferes with the mechanical connection between a controller and a final control element that determines the quantity of fuel to be injected after a false signal has been output by a signal processing unit to a switchover element which switches over control of the final control element to the simple regulator.

U.S. Pat. No. 4,748,566 relates to an engine control apparatus for internal combustion engines which engine control has two computing means, one for main engine control signals and the other redundantly provided for auxiliary engine control signals. Switching from the main to the auxiliary engine control signals occurs when the computing means for the main engine control signal is not properly operating. When the number of changes of state in the output of the main computer monitor exceeds a predetermined value, the malfunction of the main computer is determined to be serious so that the back up computer provides a switching request signal. Under the condition of the existence of the switching request signal and confirmation that the back up computer is properly operating, switching from the main to the back up computer takes place.

While the foregoing engine control systems are, in many cases effective, they are often complicated or are adapted-only to specific engine arrangements. Accordingly, there exists a need for a simple, yet effective, engine control and management system which will switch power from one control to another under certain predetermined conditions.

Accordingly, it is a primary object of the present invention to provide an engine management system for internal combustion engines which has a primary and a secondary control unit which each sense selected parameters to make control adjustments. Switching to the secondary control unit occurs when a power switching unit is triggered by the presence or loss of specific output signal from the primary control unit.

It is another object of the present invention to provide an engine management system applicable to internal combustion engines of various types which system is simple and which relies upon a specific output signal from the primary system to initiate switching.

Another object of the present invention is to provide an engine management and control system which will, upon the occurrence of certain events, switch to a secondary control system capable of controlling engine operation based on sensed parameters instead of relying upon selected default values.

It is another object of the present invention to provide an engine management control system which can be operated to control any selected number of fuel injectors and which can redirect the output of the power supply circuit based on any number of selected operating conditions.

It is another object of the present invention to provide a primary engine control unit which may be configured to receive information from and send instructions to one or two ignition systems.

SUMMARY OF THE INVENTION

The present invention is an engine management system which may be used in conjunction with internal combustion engines used in various applications such as in connection with engines for both fixed and rotary wing aircraft as well as motor vehicle engines. The system regulates fuel delivery using a microprocessor controlled system in conjunction with an electro-mechanical switching system. The microprocessor associated with the primary control unit interprets signals from selected system sensors to determine current operational fuel requirements. Switching to the secondary system is automatically accomplished by a power supply control or switching circuit. The power supply switching circuit is triggered by a specific output signal from the primary control unit. Events which can initiate triggering include, but are not limited to, single or multiple input sensor failures, microprocessor failures. Warning lights and digital displays may be connected to the microprocessor in order to inform the pilot or operator of system conditions. The engine management system of the invention may be configured to rely on any number of selected parameters or conditions and may be as simple or as sophisticated as required by the particular application. The system is particularly suited for regulating fuel delivery to internal combustion aircraft engine systems which aircraft systems have two independent sources of electrical power.

BRIEF DESCRIPTION OF THE DRAWINGS

The invention, and the above cited objects and advantages, will be best understood by reference to the following description, taken in conjunction with the accompanying drawings in which:

The present invention is a management system for regulating fuel delivery by controlling fuel injectors. The system of the invention may be utilized in connection with various engine applications such as automotive engines and is particularly adapted to aircraft engine fuel systems such as systems for rotating wing aircraft or helicopters. FIG. 1 illustrates a typical fuel system for a rotating wing aircraft or a helicopter which shows the fuel path. The engine management control system of the present invention regulates the fuel injectors which provide atomized fuel to the engine cylinders. Fuel injectors are used in some aircraft engines instead of carburetors because of their reliability and availability. The description of the fuel system is set forth to facilitate an understanding of the engine management system.

Figure 1:
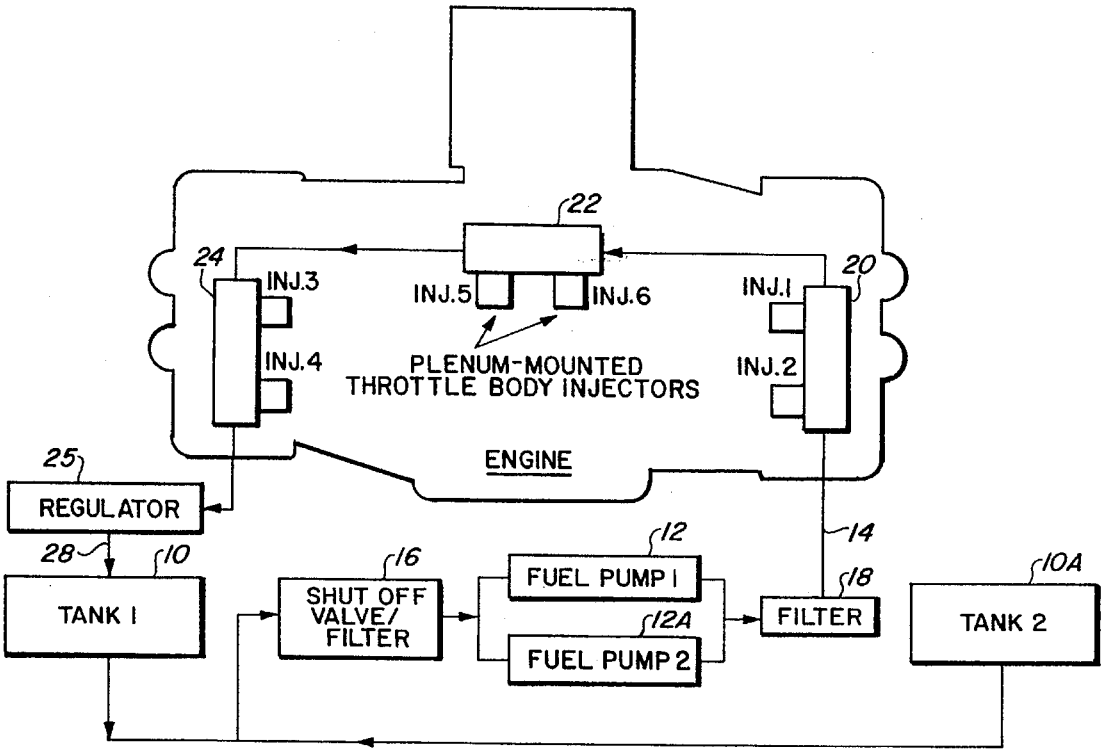
FIG. 1 is a diagrammatical representation of a representative fuel feed system used in conjunction with the engine management system of the present invention.

The fuel system includes a fuel supply shown having dual fuel tanks 10 and 10A. The system has a primary fuel supply path which include fuel pumps 12 and 12A which deliver fuel to injectors 1 to 4 via conduit 14 in which a first fuel filter shut-off valve 16 is interposed ahead of the fuel pumps 12 and 12A. The fuel pumps pressurize the fuel which then passes through filter 18 located downstream of the fuel pumps. The fuel injectors 1 to 4 may be any suitable type such as Bosch Pulse Type, Model No. 0280150/803.

The fuel pumps operate from separate power circuits and are both energized during normal operating conditions. Gravity safety switches, not shown, are installed in the power supply lines to the fuel pump 12 and 12A and serve to disconnect power to the fuel pumps in the event of a sudden impact.

Pressurized fuel is directed via conduit 14 to a distribution block 20 containing injectors 1 and 2 which are located in the intake runners of the #1 and #2 cylinders. Fuel passes from distribution block 20 to the secondary or throttle body distribution block 22 which directs fuel to the secondary injectors 5 and 6 when necessary. When the system is operating under control of the secondary ECU, injectors 1 to 4 are disabled and fuel is provided to the engine by injectors 5 and 6. The alternate injectors may be located at the cylinders or may be plenum mounted, as shown. Fuel is then directed to distribution block 24 which houses injectors 3 and 4 associated with cylinders 3 and 4. A fuel pressure regulator 25 maintains a constant, predetermined pressure in the fuel delivery system. Un-used fuel is returned to the tank 10 via line 28 from the regulator 25.

Figure 2:
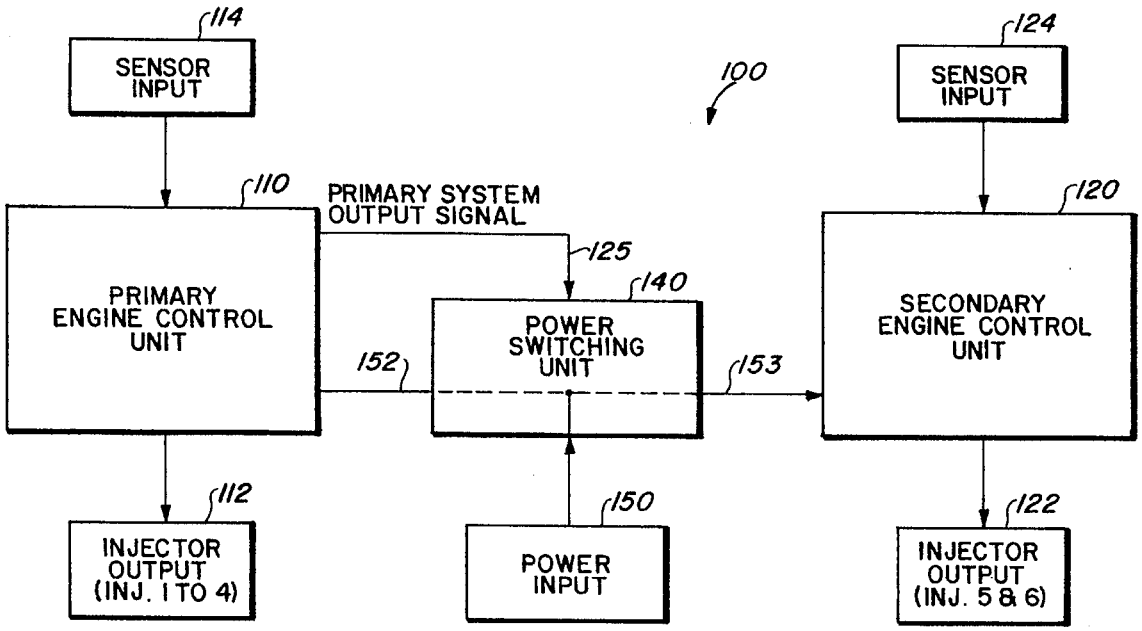
FIG. 2 shows a basic block diagram of an engine controller management system according to the present invention.

The engine management system of the present invention is shown in broad diagrammatic form in FIG. 2 and is utilized to control the injectors 1 to 4 as shown in FIG. 1. The system regulates fuel delivery using a microprocessor controlled system which is supplemented by an electronic emergency system. The microprocessor interprets signals from system sensors to determine operational fuel requirements. The system then regulates fuel delivery by controlling the electronic fuel injectors. In the event of sensor failure, the microprocessor uses alternate sensor inputs or default values to determine the fuel requirement of the system. Switching to the emergency system is automatically accomplished by a power switching unit which is triggered by a specific output signal from the primary control unit. Criteria for switching, may include but is not limited to, single or multiple input sensor failure, microprocessor failure, or power failure. Warning lights and digital displays may be provided in order to advise the operator of system conditions.

As seen in FIG. 2, the system is generally designated by the numeral 100 and includes a primary engine control unit (ECU) 110 and a secondary engine control unit 120. Under normal operational conditions, the primary engine control unit 110 will emit an output signal 112 which controls the operation of the primary fuel injectors, shown in FIG. 1.

The primary engine control unit includes a microprocessor which is programmed to calculate and determine the appropriate rate of fuel supply to the engine depending upon the sensed parameters. The sensed parameters are collectively shown at input 114 and, as will be described in detail hereafter, may include any number of appropriate parameters or conditions necessary to determining fuel supply. When the primary engine control unit 110 is properly functioning, a primary system output signal 125 is sent to the power switching unit 140. The power switching unit receives power from power input source 150 and, under normal operating conditions, will direct power to the primary engine control unit 110 through line 152. The secondary engine control unit 120 remains inactive during normal operation and once activated operates in response to sensor inputs 124, In the preferred embodiment, the primary engine control unit as will be explained in greater detail with reference to FIGS. 3 to 4, monitors certain primary parameters as well as selected secondary parameters. Upon the occurrence of predetermined events, such as the failure of the primary sensors or injection failure, power loss, erratic computer behavior, the secondary engine control unit 120 is automatically engaged and the primary engine control unit 110 disengaged by the power switching unit 140. In most cases, a transition of fuel control due to component failure occurs so quickly and smoothly that the operator's only indication of failure and transition will be a warning light indicator which in aircraft applications is tested during each pre-flight check.

Figure 3:
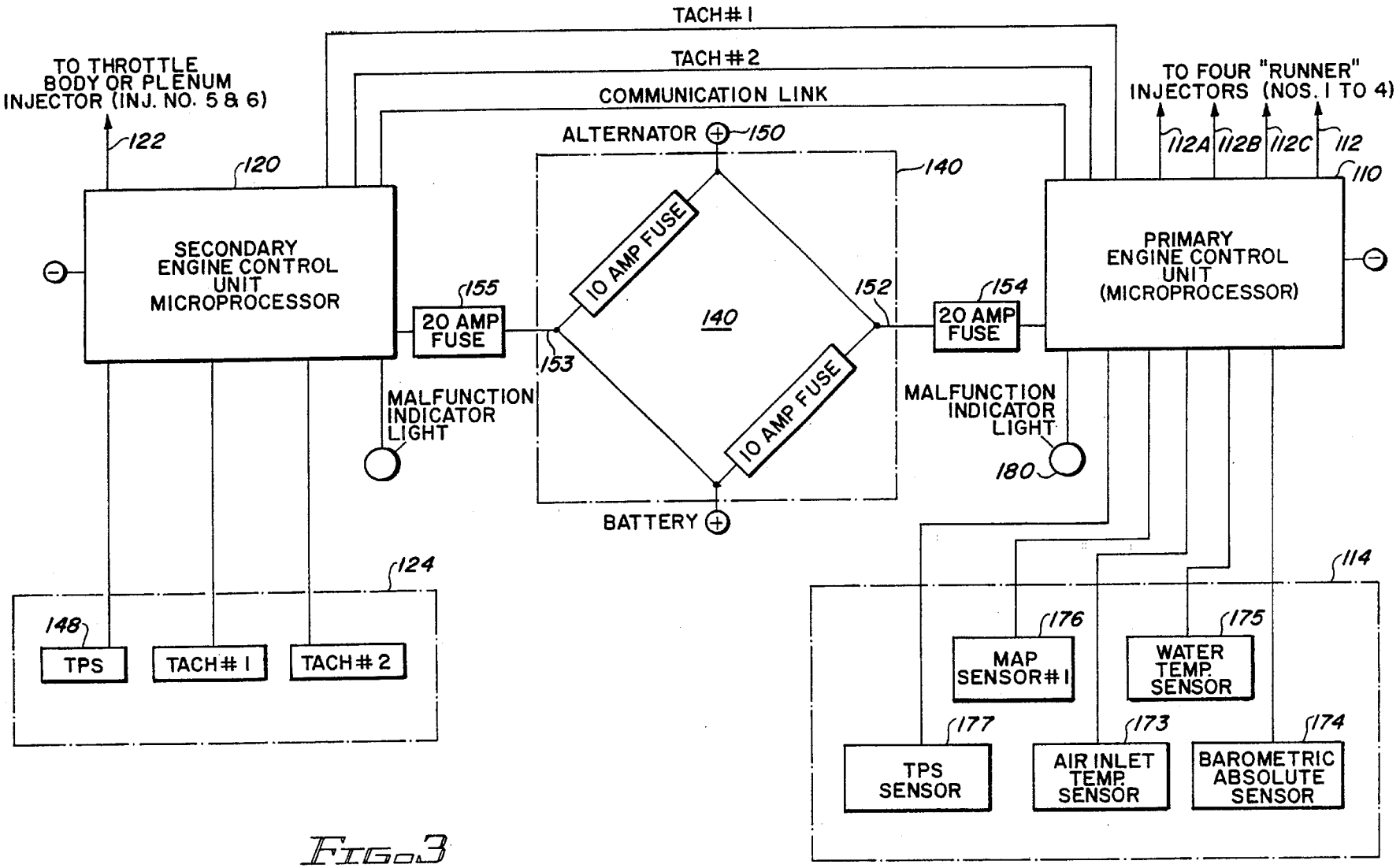
FIG. 3 is a more detailed diagram of the engine management system of the present invention.

FIG. 3 is a more detailed schematic of the system configuration. In FIG 3, the primary and secondary engine control units 110 and 120 are shown and are operatively interconnected by the power switching unit 140. The power switching unit is connected to a source of power 150 shown as a battery connected to a charging circuit to an alternator. Normally the power switching unit will provide power to the primary engine control system via 152 across a suitable fuse 154. In the event of occurrence of predetermined conditions, the power switching unit 140 will serve to terminate power to the primary engine control unit 110 and disable this unit and activate secondary engine control unit 120 by providing power via conduit 153 across fuse or breaker 155.

The primary control unit 110 under normal operations sends operational signals via lines 112 to 112C to the runner injectors numbered 1 to 4 in FIG. 1. The primary engine control unit 120 includes a main processing chip which in the preferred embodiment is an HPC46003 16-bit-20MHC chip manufactured by National Semiconductor and operated at 16 MHz. The computer includes an A/D conversion link and a serial/10 bit converter. The computer is environmentally protected from temperature extremes, moisture and electrical interference and has polarity protected inputs and outputs. The microprocessor operates on a voltage from 6 to 16 vdc in accordance with production standard IPC-S-815-A Class 3. The microprocessor is programmed to monitor various engine functions and send the appropriate control signal to the injectors. The primary sensors monitor ignition and load which is determined by monitoring throttle position at 177 and/or manifold pressure at 176. In the preferred embodiment of the system, throttle position is used as the primary load sensor. Should the throttle position sensor fail, the microprocessor in the primary ECU 110 is programmed to immediately switch to the manifold pressure sensor for the load factor to determine the proper air/fuel ratio.

In addition to the primary sensors, various selected secondary sensors indicative of engine performance may also be utilized. The secondary sensors are primarily for "fine tuning" the primary control parameter in that they modify the air/fuel (A/F) ratio based on local conditions such as temperature and elevation. Various sensors are shown and include air inlet temperature 173, water temperature 175 (for water cooled engines), and absolute barometric pressure 174. It will be obvious to those skilled in the art that various other engine parameters and operating condition parameters may be sensed and utilized to control the A/F ratio.

Sensors are known to those skilled in the control arts. The following is a description of various sensor types utilized in a commercial embodiment of the invention which is set forth to aid in understanding the invention and is to be considered illustrative and not to be taken as limiting.

Air temperature sensor element number 173 in FIG. 3 is a two lead, one input and output signal wire terminal. The sensor input from the ECU is 5 volts. The signal back to the ECU varies with the air temperature in the plenum. The higher the temperature, the lower the resistance and the ECU reads a higher voltage signal between 0–5 volts.

Water temperature sensor element number 175 in FIG. 3 has two leads and receives a 5 volt input from the ECU. The sensor sends a variable output signal back to the ECU representing the temperature of the water. The ECU signal is 0–5 volts and a higher temperature results in a higher voltage reading.

Throttle position sensor element number 177 in FIG. 3 is a rheostat-type with a D-drive rotor operated by the aircraft throttle shaft. The sensor has a 5 volt input and provides a varying signal back to the ECU.

Manifold absolute pressure and barometric sensor element numbers 174 and 176 in FIG. 3 are of the 2 bar, three lead type and are pressurized having a pressure range of 0–29.4 psia. These are used to inform the ECU of the load being applied to the engine. The ECU uses the manifold air pressure sensor and barometric sensors to circulate the proper amount of fuel to inject the proper ignition timing to apply.

Each of the secondary sensors 173, 174 and 175 have default settings which are predetermined. For example, if the system is used in an aircraft, the default setting for barometric pressure is standard day pressure at 3,500 feet. As most aircraft fly between sea level and 7,000 feet, loss of this particular sensor would not normally interrupt flight but would result in the engine running a little too rich or too lean, depending upon the particular altitude of the aircraft. However, loss of a secondary sensor is immediately brought to the pilot's attention by means of illumination of an appropriate warning light 180 on the instrument panel. Concurrently, a digital display screen informs the pilot as to the failure of a particular secondary sensor so manual adjustments may be made. A pilot operating at 7,000 feet altitude would know from experience that the fuel mixture was too rich and could make appropriate adjustment.

The primary sensors 176 and 177, respectively, monitor throttle position and manifold air pressure and are indicative of engine speed and load. In the unlikely event that both the throttle position sensor 177 and the manifold pressure sensor 176 should fail, the microprocessor operates to automatically transfer to the secondary engine control unit without interruption.

If both of the primary sensors 176, 177 fail, the power switching unit 140 will automatically divert power from the primary engine control unit 110 to the secondary engine control unit 120. The secondary ECU is intended as an emergency system and monitors only one or more basic, selected parameters necessary to operation of the engine. In the preferred embodiment, the parameter monitored by the secondary ECU is throttle position (MAP) at 148, although additional inputs such as manifold air pressure could also be selected. Although the engine will operate using the secondary ECU, recommended procedure is for the pilot to land as quickly as possible using the emergency system and not unnecessarily rely on the secondary ECU for operation.

The secondary engine control unit 120 also includes a microprocessor which receives the information transmitted from the sensor which, as indicated in the preferred embodiment is throttle position. The microprocessor sends an appropriate signal to the plenum-mounted fuel injectors 5 and 6 to deliver the proper air/fuel ratio to the injectors. The microprocessor in the secondary ECU may be any suitable unit and in the preferred embodiment the microprocessor is a Motorola Microprocessor Model No. QLKA9422 which is programmed to allow the unit to control fuel delivery over the entire operating range of the particular power plant or engine.

Figure 4:
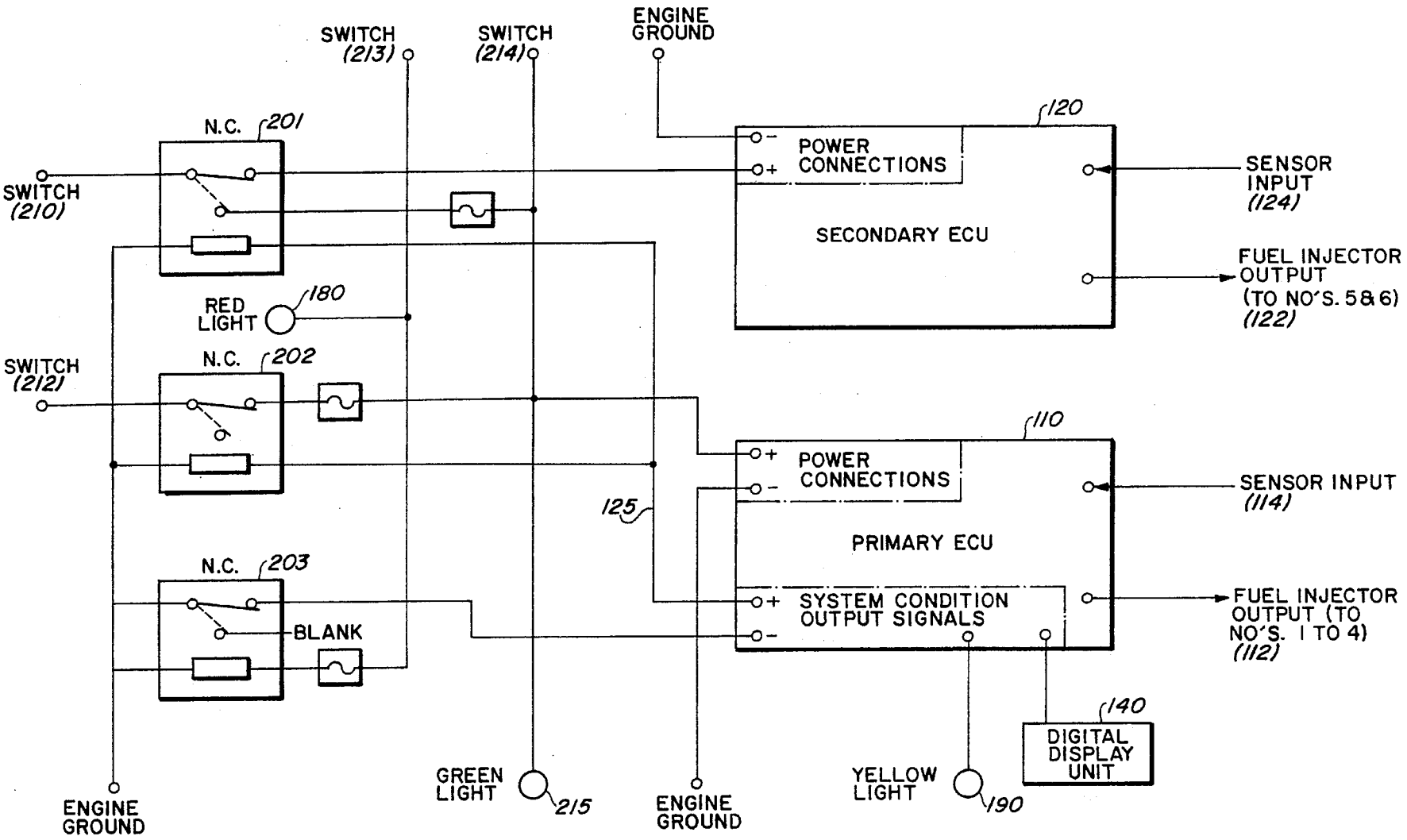
FIG. 4 is a schematic diagram of the relay circuit of the power switching unit shown connected to the primary and secondary engine control units.

The switching operation is accomplished by the power switching unit 140 which is shown in detail in FIG. 4 and is an electro-mechanical system. In FIG. 4, the switching unit includes three normally closed relays 201, 202 and 203. Relays 201 and 202 are connected to an independent power supply and relay 203 prevents activation of both the primary engine control unit 110 and the secondary engine control unit 120 at the same time. The switch 210 supplies power to relay 201 and switch 212 supplies power to relay 202. Both relays supply power to both the primary and secondary ECU depending on the relay position. In addition, the circuit includes emergency secondary activation switch 213 and primary system activation switch 214 which is a momentary switch used to power the primary ECU which, in turn, activates both power relays 201, 202, allowing the main power switches 210, 212 to power the primary ECU when activated.

The primary ECU emits an output signal identified by numeral 125 which may be a 12 volt or other output or condition signal directed to relays 201 and 202. The system is initially activated by the operator closing switch 214 which is the primary system activation switch which momentarily is switched to turn on the primary ECU. This activates both the power relays 201 and 202 allowing the main power switches to feed the primary ECU when engaged. Switches 210 and 212 will be engaged and the normally closed relays 201 and 202 will be opened by the momentary switch 214 and will remain open. This will energize the green light 215 indicating the system is operating properly.

In the event of a failure of the type described above, that is both of the primary sensors to the primary ECU are lost or another malfunction occurs such as erratic computer behavior, the system condition signal 125 emanating from the primary ECU to the relays 201 and 202 will be lost. This will result in the relays 201, 202 closing (moving to the position shown in solid lines) since they are both biased to the position shown in dotted. The closing of relays 201 and 202 will then direct power to the secondary ECU. Power to the primary ECU will be disconnected by relays 201 and 202. The system has now automatically switched to the secondary or auxiliary system in which position the system now operates with only one or more key parameters being sensed which are basic for engine control. In the case of a rotating wing aircraft or other aircraft, it is preferred that throttle position be sensed and provided to the secondary ECU at sensor input 124.

Switch 213 is an emergency secondary activation switch. If the operator wishes to switch to the emergency system, the operator may accomplish this by activating switch number 213 which connects power directly to the positive power connection of the secondary ECU. The red malfunction light 180 will illuminate indicating that the system is operating on the secondary system and the ground connection to the primary ECU is interrupted at relay 203.

The primary control system can be configured to be as simple or as complex as required using a variety of sensed parameters to indicate engine operating conditions. The system may control any selected number of fuel injectors and change the output to the power supply based on any number of conditions. The power supply circuit can:

(1) Switch a single or a double source of electrical power between the main and emergency system;

(2) Be a simple electro-mechanical system;

(3) Prevent both the primary and secondary systems from being powered simultaneously;

(4) Receive information and send instructions to one or more ignition systems.

(5) Switch power to the secondary system in reaction to a simple positive and/or negative voltage output or loss from the main system;

(6) Switch power as a result of manual activation.

The emergency or secondary control system can:

(1) Use the same or different injectors to deliver fuel;

(2) Use the same sensor or use default values;

(3) Be made as simple or complex as is necessary to the specific application.

Although a preferred embodiment of the system of the present invention has been shown and described herein, it will be understood that various changes, alterations and modifications may be made to the system without departing from the spirit and scope of the appended claims.

I claim:

1. An engine management system for controlling fuel delivery to an internal combustion engine having fuel delivery apparatus comprising:

(a) a primary engine control unit including a microprocessor, said microprocessor being connected to first sensing means to receive and process signals representative of first predetermined operating conditions and providing an output signal to said fuel delivery apparatus and a control signal indicative of the operating condition of said primary engine control unit;

(b) a secondary engine control unit including a microprocessor connected to second sensing means to receive and process signals representative of a second predetermined operating condition to send an output signal to said fuel delivery apparatus; and (c) power switching control unit connected to a supply power and having switch means to direct said power supply to said primary engine control unit under normal operating conditions and maintaining said secondary engine control unit disconnected from power supply under said normal operating conditions, said switch means being operative to disconnect said primary engine control unit from said power supply and to connect said secondary engine control unit to power supply upon a predetermined change in said control signal from said primary engine control unit.

2. The engine management and control system of claim 1 wherein said primary engine control unit is connected to third sensing means which fine tune the control signal indicative of operating conditions.

3. The engine management and control system of claim 2 wherein said third sensing means is provided with predetermined default values in case of failure.

4. The engine management and control system of claim 1 wherein said engine is an aircraft engine and said fuel delivery apparatus comprise fuel injectors.

5. The engine management and control system of claim 4 wherein said fuel injectors include primary runner injectors and secondary plenum mounted injectors.

6. The engine management and control system of claim 1 wherein said engine is an aircraft engine and said first predetermined operating condition includes throttle position.

7. The engine management and control system of claim 2 wherein said third sensing means monitor barometric pressure and air temperature.

8. The engine management and control system of claim 1 wherein said engine is an aircraft engine and said second predetermined operation condition is manifold pressure.

9. The engine management and control system of claim 1 wherein said power switching control unit includes at least first and second relays connected across first and second switches respectively to a power source and wherein said primary engine control unit is connected so that the operating condition signal is a voltage signal provided to first and second relays which, upon interruption, will cause said relays to place said secondary engine control unit in communication with said power source and interrupt power to said primary engine control unit.

10. The engine management and control system of claim 9 including third relay means connected to said first and second relay means and to third switch means to prevent simultaneous actuation of said primary and secondary engine control units.

11. The engine management and control system of claim 9 further including a momentary actuator switch circuit selectively operable to initially position said first and second relays to direct power to said primary engine control unit.

12. The engine management and control system of claim 11 further including an emergency actuation switch circuit which is operative to actuate said secondary engine control unit.

* * * * *